US005752583A

United States Patent [19]

Schönewald

[11] Patent Number: 5,752,583

[45] Date of Patent: May 19, 1998

[54] INDUSTRIAL TRUCK WITH A LIFTING FRAMEWORK

[75] Inventor: Peter Schönewald, Stapelfeld, Germany

[73] Assignee: Still GmbH, Germany

[21] Appl. No.: 641,110

[22] Filed: Apr. 29, 1996

[30] Foreign Application Priority Data

May 4, 1995 [DE] Germany ..... 195 16 416.4

[51] Int. Cl.[6] ..... B66F 9/06

[52] U.S. Cl. ..... 187/227; 414/629

[58] Field of Search ..... 187/227, 229, 187/234; 414/630, 629

[56] References Cited

U.S. PATENT DOCUMENTS

| | | | |
|---|---|---|---|
| 3,061,047 | 10/1962 | Gunning | 187/229 |
| 4,485,894 | 12/1984 | Soule et al. | 187/229 |
| 4,940,381 | 7/1990 | Rysewyk | 414/619 |
| 5,000,293 | 3/1991 | Brown et al. | 187/227 |

FOREIGN PATENT DOCUMENTS

| | | |
|---|---|---|
| 1178867 | 1/1970 | United Kingdom . |
| 1578104 | 10/1980 | United Kingdom . |
| 2196935 | 7/1982 | United Kingdom . |
| 2091310 | 5/1988 | United Kingdom . |
| 2247875 | 3/1992 | United Kingdom . |

*Primary Examiner*—Kenneth Noland
*Attorney, Agent, or Firm*—Thomas R. Shaffer, Esq.

[57] ABSTRACT

An industrial truck having a lifting slide which is moveable up and down on a lifting framework is disclosed. The lifting framework is fixed to at least one vertical load chain by at least one chain connecting piece. The load chain is at least partly guided in a chain guide which has an opening on at least one side. With this arrangement, the load supporting chain does not damage or soil other components of the industrial truck when travelling over irregularities in the ground.

14 Claims, 2 Drawing Sheets

INDUSTRIAL TRUCK WITH A LIFTING FRAMEWORK

BACKGROUND OF THE INVENTION

1. Field of the Invention

The invention concerns an industrial truck with a lifting slide which is guided for upward and downward movement on a lifting framework and is fixed to at least one essentially vertical load supporting chain by means of at least one chain connecting piece.

2. Description of the Prior Art

Examples of industrial trucks of this kind are fork lift trucks, high lift trucks or high lift order picking trucks. Load supporting means, such as for example load forks or platforms, and in the case of order picking trucks also a driver platform, are fixed to the lifting slide which is vertically movably guided on the lifting framework. The chain connecting piece constitutes the connection between the lifting slide and the load supporting chain. The lifting slide can be pulled upwards and lowered again with the load supporting chain which is usually arranged vertically.

The load supporting chain is usually a roller type chain, the axes of whose rollers extend laterally with respect to the vehicle. Vertical runs of the chain can thus flex about these axes to cause the chain to oscillate in a longitudinal plane of the vehicle. When there is no load on the load supporting means, the load supporting chain is only tensioned by its own weight and by the combined weight of the load supporting means, the lifting slide and the chain connecting piece. This low pre-loading then leads to the load supporting chain flexing or 'slapping' when the vehicle travels over irregularities in the ground for example. The two directions in which the load supporting chain tends to slap preferentially due to the mobility of the chain links are to the front and to the rear. Slapping of the load supporting chain may also be observed in the sideways direction at right angles to the longitudinal axis of the vehicle. Components located in the vicinity of the load supporting chain such as, for example, lifting cylinders or mast profiles, can be damaged by contact with the slipping chain. Apart from this, the industrial truck is soiled by splashes of grease which detach from the load supporting chain when it slaps.

SUMMARY OF THE INVENTION

The underlying object of the present invention is to provide an industrial truck whose load supporting chain does not damage or soil other components when travelling over irregularities in the ground.

According to the invention, this object is achieved in that the load supporting chain is at least partly guided in a chain guide open on at least one side.

The position of the load supporting chain in the directions at right angles to its length is determined by the chain guide while it can be moved freely in the longitudinal direction, in line with its function. Neighboring components are protected against damage by the load supporting (or 'load chain') in that slapping of the load chain is prevented by the chain guide. Soiling by droplets of grease splashing off the load chain is also prevented.

In one advantageous development of the invention, the chain connecting piece extends through the opening on one side of the chain guide from the lifting slide to the load chain. The lifting slide and hence the chain connecting piece are moved upwards and downwards relative to the chain guide. To ensure that the chain connecting piece does not collide with the chain guide during this movement, the chain connecting piece extends through the opening on one side of the chain guide.

It is expedient if the breadth of the opening on one side of the chain guide is such that the position of the load chain in the direction of the opening in the chain guide is also determined by the chain guide. Such a design of the chain guide means that the freedom of movement of the load chain is not increased due to the opening in the chain guide.

It is also advantageous if the opening in the chain guide is located in the lateral area of the chain guide. The connection between the load chain and the lifting slide by means of the chain connecting piece is then effected through the opening in the lateral area of the chain guide. The chain guide can be closed on the other sides so that the chain guide reliably prevents the chain slapping to the front and the rear.

It is particularly advantageous if the opening in the lateral area of the chain guide exhibits a lesser breadth than the clearance parallel with it inside the chain guide. Then, load chain slap is prevented in the direction of the opening since when the chain links deflect to the front or rear, the entire clearance within the chain guide is filled by the chain.

One advantageous development of the invention is characterized in that the lifting framework exhibits at least one mast and in that the load chain, viewed in the line of sight of the driver, is located exactly in front of or exactly behind the mast. With this arrangement of the load chain and hence the chain guide, the field of view of the driver is not additionally restricted by the chain guide.

In an advantageous embodiment, the chain guide takes the form of a guide rail closed on three sides. In this embodiment, the chain guide is a separate component which can be lifted or removed as required.

It is also expedient if the lifting framework has at least one mast and the chain guide is formed by the mast on at least one side of the load chain and by a guide rail on at least one further side of the load chain. This embodiment minimizes the construction work required for the chain guide and also limits the space required for the chain. The fact that the slapping of the load chain is prevented means that the load chain can be disposed very close to the lifting mast.

One advantageous development of the invention is characterized in that damping elements are fixed to the inside and/or to the outside of the chain guide. The noises created by the movements of the load chain inside the chain guide are thus attenuated.

It is also expedient if damping elements are fixed to the chain. This measure also helps to minimize the noise created as the chain contacts the chain guide.

One particular advantage is obtained if the industrial truck exhibits a telescopic lifting framework with two external masts which are vertically immovable and two internal masts which are moveable vertically and to which a lifting slide is fixed so as to be moveable up and down and one load chain is disposed exactly in front of or behind each of the two internal masts, viewed in the line of sight of the driver. In this way, the space required for the lifting framework and the load chain and at the same time the restriction of the field of vision of the driver by the lifting framework can be minimized, even with telescopic lifting frameworks.

One advantageous development is characterized in that forward portion of the chain guide is formed by the internal mast and the chain guide in the other directions is formed by a guide rail fixed to the external mast or to the internal mast. When driving with the lifting slide lowered, the chain is completely surrounded by the chain guide, preventing any chain slapping. Even when the lifting framework is extended, the load chain is guided by the internal mast in at least one direction.

One particular advantage is obtained if the industrial truck has a telescopic lifting framework which is guided in at least one direction by the internal mast.

BRIEF DESCRIPTION OF THE DRAWINGS

And embodiment of the invention will now be described in greater detail with reference to the accompanying drawings, in which.

DETAILED DESCRIPTION OF THE PREFERRED EMBODIMENT

Figure 1:
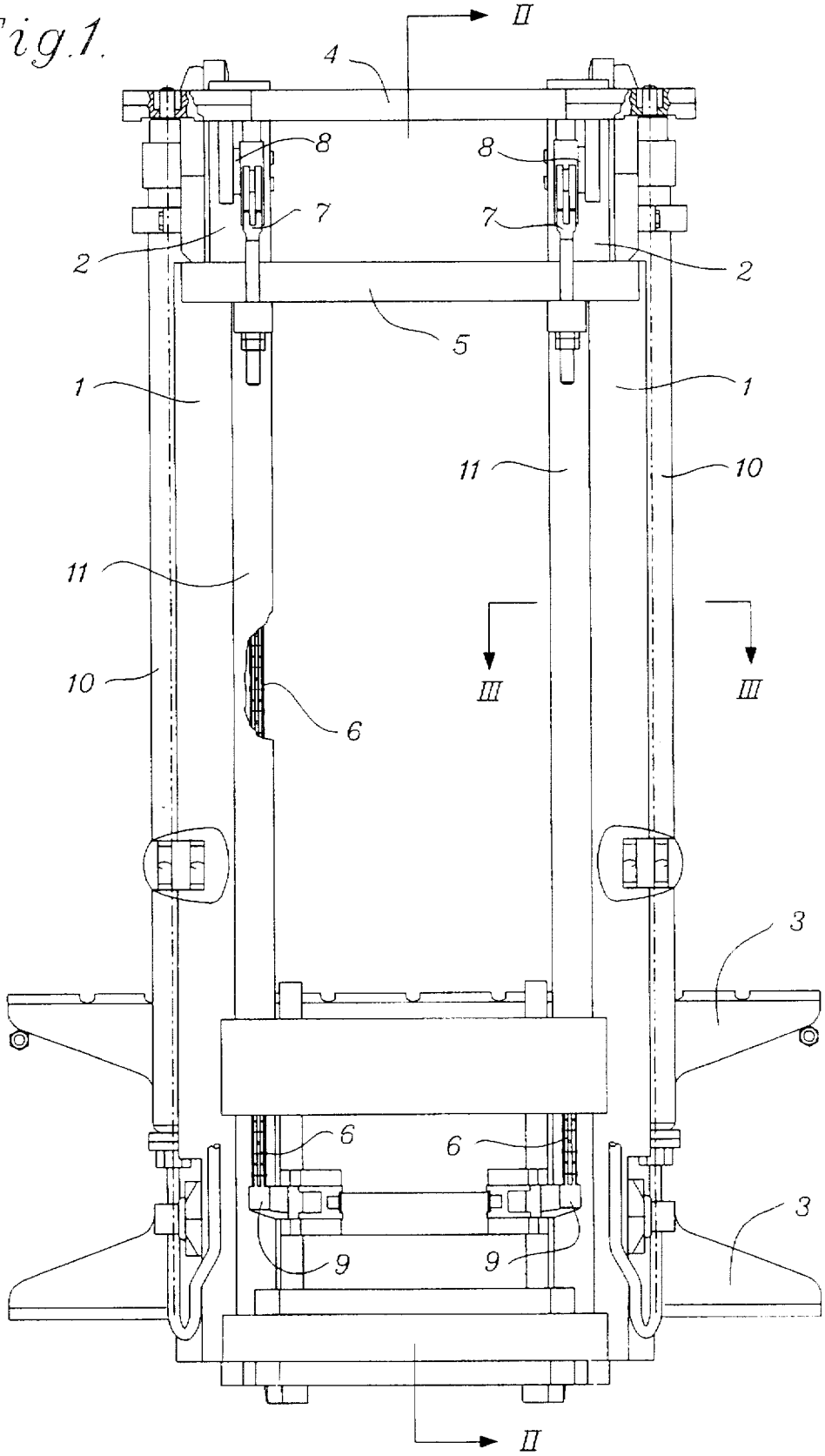
FIG. 1 shows the lifting framework of an industrial truck.

Referring now to the figures, FIG. 1 shows a telescopic lifting framework of an industrial truck. The lifting framework consists of two vertically fixed external masts 1 and two internal masts 2 which are moveable vertically along the external masts 1. The lifting slide 3 is again vertically movably guided on the internal masts 2. The two internal masts 2 are connected together with a transverse member 4 and the two external masts 1 are connected together with a connecting member 5. The two load chains 6 are fixed to the connecting member 5 attached to the external masts 1 with a fixing element 7. From this fixing element 7, the load chains extend upwardly to the guide rollers 8. The guide rollers 8 are rotatably fixed to the transverse member 4 extending between the internal masts 2. From the guide rollers 8, the load chains 6 extend downwardly to the chain connecting piece 9 with which the load chains are fixed to the lifting slide 3. Lifting cylinders 10 which act through their lower end on the external masts 1 are disposed to the side of the lifting masts. The upper end of the lifting cylinders 10 is connected to the transverse member 4 of the internal masts 2. In the position shown, the lifting slide 3 is in its lowest position. Now if the lifting cylinders are extended, the internal masts 2 with the transverse member 4 and the guide rollers 8 move upwards. Because of the guidance of the load chains 6 once over the guide rollers, the load and the lifting slide 3 then moves upwards at double the speed.

Guide rails 11 according to the invention for the load chain 6 are fixed to the external masts 1. These confine the load chain to the rear and to the side in the illustrated position of the lifting slide. The internal masts 2 of the lifting framework are located in front of the load chains. In the illustrated position of the lifting slide 3, which is preferably used for travelling over fairly long distances, the majority of the load chains 6 are located inside the chain guides formed by the guide rails 11 and the internal masts 2. This prevents the slapping of the load chain and splashing of the grease applied to lubricate the load chain.

Figure 2:
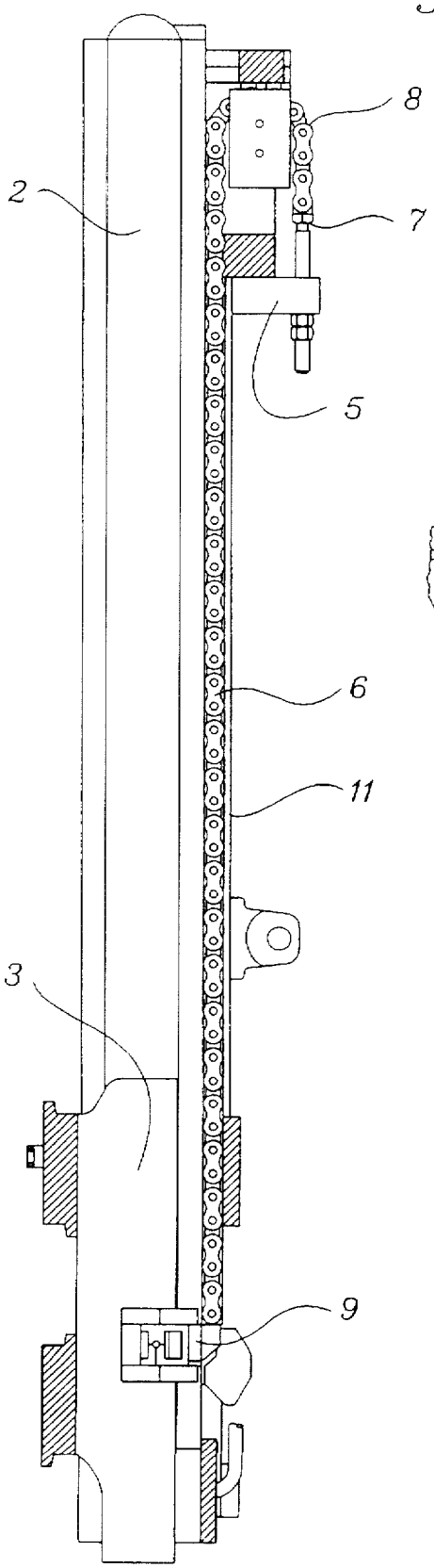
FIG. 2 is a section along line B—B of FIG. 1.

FIG. 2 shows the section B—B through the lifting framework according to the invention. In it an internal mast 2 can be seen on which the lifting slide 3 is guided. The illustration also clearly shows the arrangement of the load chain 6, starting from the fixing element 7 attached to the connecting member 5 and passing over the guide roller 8 to the chain connecting piece 9. The, load chain 6 is for the most part inside the chain guide formed by the internal mast 2 and the guide rail 11.

Figure 3:
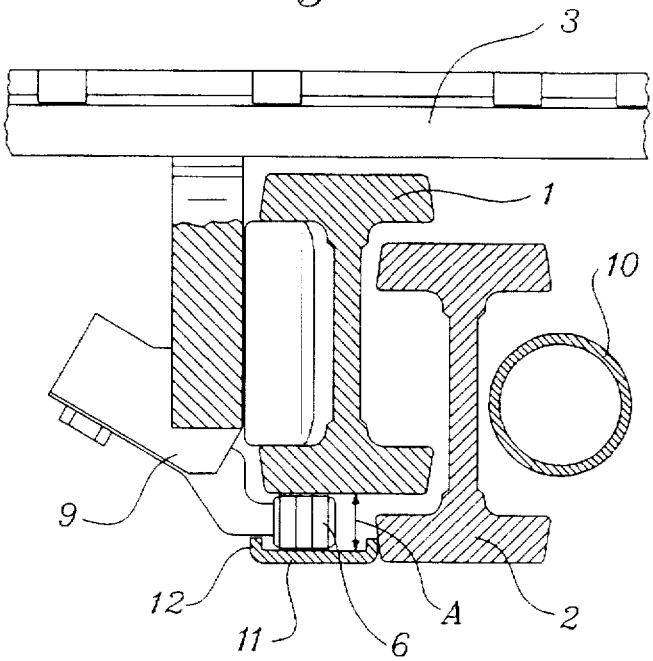
FIG. 3 is a section along line A—A of FIG. 1.

The section A—A through the lifting framework is shown in FIG. 3. In this illustration, the shape of the guide rail 11 for the lifting chain is particularly clear. The edge 12 of the guide rail 11 is bent inwards in the end area. The breadth of the opening in the chain guide is smaller than the clearance A parallel with it inside the chain guide. Thus, the position of the lifting chain 6 in the direction of the chain connecting piece 9 is also determined.

While certain presently preferred embodiments of the present invention have been described and illustrated, it is to be distinctly understood that the invention is not limited thereto but may be otherwise embodied and practiced within the scope of the following claims.

I claim:

1. An industrial truck with a lifting slide (3) which is guided movable up and down on a lifting framework and is fixed to at least one essentially vertical load chain (6) by means of at least one chain connecting piece (9), wherein the load chain (6) is at least partly guided in a chain guide, said chain guide having an opening on at least one side, wherein the chain connecting piece (9) extends through the opening on one side of the chain guide from the lifting slide (3) to the load chain (6).

2. An industrial truck according to claim 1, wherein the lifting framework has at least one mast (1, 2) and in that the load chain (6), as viewed in the line of sight of the driver, is located exactly before or exactly behind the mast (1, 2).

3. An industrial truck according to claim 1, wherein the chain guide takes the form of a guide rail (11) closed on three sides.

4. An industrial truck according to claim 1, wherein damping elements are fixed to at least one of an inside and an outside of the chain guide.

5. An industrial truck according to claim 1, wherein damping elements are fixed to the chain.

6. An industrial truck according to claim 1, wherein the industrial truck has a telescopic lifting framework with two external masts (1) which are not moveable vertically and two internal masts (2) which are moveable vertically and to which the lifting slide (3) is fixed moveable up and down and, in each case, one load chain (6), as viewed in the line of sight of the driver, is located exactly before or exactly behind the two internal masts.

7. An industrial truck with a lifting slide (3) which is guided movable up and down on a lifting framework and is fixed to at least one essentially vertical load chain (6) by means of at least one chain connecting piece (9), wherein the load chain (6) is at least partly guided in a chain guide, said chain guide having an opening on at least one side, wherein the breadth of the opening on one side of the chain guide is such that the position of the load chain (6) in the direction of the opening in the chain guide is also determined by the chain guide.

8. An industrial truck according to claim 7, wherein the lifting framework has at least one mast (1, 2) and in that the load chain (6), as viewed in the line of sight of the driver, is located exactly before or exactly behind the mast (1, 2).

9. An industrial truck according to claim 7, wherein the chain guide takes the form of a guide rail (11) closed on three sides.

10. An industrial truck according to claim 7, wherein damping elements are fixed to at least one of an inside and an outside of the chain guide.

11. An industrial truck according to claim 7, wherein damping elements are fixed to the chain.

12. An industrial truck according to claim 7, wherein the industrial truck has a telescopic lifting framework with two external masts (1) which are not moveable vertically and two internal masts (2) which are moveable vertically and to which the lifting slide (3) is fixed moveable up and down and, in each case, one load chain (6), as viewed in the line of sight of the driver, is located exactly before or exactly behind the two internal masts.

13. An industrial truck with a lifting slide (3) which is guided movable up and down on a lifting framework and is fixed to at least one essentially vertical load chain (6) by means of at least one chain connecting piece (9), wherein the load chain (6) is at least partly guided in a chain guide, said chain guide having an opening on at least one side, wherein the opening in the chain guide is located in the lateral area of the chain guide and wherein the opening in the lateral area of the chain guide has a lesser breadth than a clearance (A) parallel with it inside the chain guide.

14. An industrial truck with a lifting slide (3) which is guided movable up and down on a lifting framework and is fixed to at least one essentially vertical load chain (6) by means of at least one chain connecting piece (9), wherein the load chain (6) is at least-partly guided in a chain guide, said chain guide having an opening on at least one side, wherein the lifting framework has at least one mast (1, 2) and wherein the chain guide is formed by the mast (1, 2) on at least one side of the load chair (6) and by a guide rail (11) on at least one further side of the load chain (6).

* * * * *

UNITED STATES PATENT AND TRADEMARK OFFICE

CERTIFICATE OF CORRECTION

PATENT NO. : 5,752,583

DATED : May 19, 1998

INVENTOR(S) : Schonewald

It is certified that error appears in the above-identified patent and that said Letters Patent is hereby corrected as shown below:

Column 3, line 65, after "The" delete ","

Column 6, line 11, after "load" delete "chair" and insert -- chain --

Signed and Sealed this

First Day of September, 1998

Bruce Lehman

*Attest:*

BRUCE LEHMAN

*Attesting Officer*

*Commissioner of Patents and Trademarks*